US007077617B2

(12) United States Patent
Itoh

(10) Patent No.: US 7,077,617 B2
(45) Date of Patent: Jul. 18, 2006

(54) VEHICLE EQUIPPED WITH LIFT DEVICE AND LIFT DEVICE

(75) Inventor: Hideaki Itoh, Maebashi (JP)

(73) Assignee: Satoh Kogyosyo Co., Ltd., Gunma (JP)

( * ) Notice: Subject to any disclaimer, the term of this patent is extended or adjusted under 35 U.S.C. 154(b) by 130 days.

(21) Appl. No.: 10/847,615

(22) Filed: May 18, 2004

(65) Prior Publication Data

US 2005/0258622 A1 Nov. 24, 2005

(51) Int. Cl.
*B66C 1/00* (2006.01)

(52) U.S. Cl. ..... 414/680; 212/300; 212/238; 212/180; 180/19; 180/74

(58) Field of Classification Search ..... 180/19, 180/74; 212/300, 238, 180; 414/735
See application file for complete search history.

(56) References Cited

U.S. PATENT DOCUMENTS 3,444,945 A * 5/1969 Coordes et al. ..... 180/19.3
3,814,531 A * 6/1974 Carnahan et al. ..... 404/117
4,135,592 A * 1/1979 Wincent ..... 180/19.2
4,280,785 A * 7/1981 Albrecht ..... 414/735
4,721,213 A * 1/1988 Eitel ..... 212/285
6,129,226 A * 10/2000 Donovan ..... 212/300
6,837,671 B1 * 1/2005 Devine et al. ..... 414/680

* cited by examiner

*Primary Examiner*—Christopher P. Ellis
*Assistant Examiner*—Cynthia F. Collado
(74) *Attorney, Agent, or Firm*—Townsend & Banta

(57) ABSTRACT

A vehicle is provided having a lift device comprising: a carrier; a swing arm with one end fixed to a shaft and another end coupled the carrier; and a drive for swinging the swing arm on top of the vehicle. The carrier is lowered from the top of the vehicle at an inclination with the point at which the carrier is attached to the swing arm raised. The swing arm comprises a first arm fixed to the shaft and a second arm mobile along the first arm that is coupled to the carrier. Telescoping means displace the second arm along the first arm when the swing arm swings, so that the carrier is retracted when the swing arm is upright. A support device supports the carrier, and support position displacement means cause it to project horizontally from the top of the vehicle when the carrier is lowered.

6 Claims, 10 Drawing Sheets

VEHICLE EQUIPPED WITH LIFT DEVICE AND LIFT DEVICE

FIELD OF THE INVENTION

The present invention relates to lift devices that allow for quick and easy loading and unloading of objects disposed on a high surface. More specifically, the present invention relates to vehicles having a lift device; and to lift devices whereby objects, such as rescue ladders mounted on the top of vehicles, can be rapidly taken down in emergency situations.

BACKGROUND OF THE INVENTION

High (elevated) surfaces, which represent dead space, are commonly advantageously used for storage of objects of various different types. For example, it is common for ladders to be mounted on the top of firefighting vehicles and for these to be used in rescuing people when there is a fire. Naturally, each time that objects are loaded or taken down from these high (elevated) places, it is necessary to go up to this high place and pass the objects up and down, which is bothersome and may be dangerous. A particular problem occurs in the case of rescue ladders mounted on the top of vehicles, as described above, in that it is not possible to take the ladder down quickly, even if there is an urgent need to use the ladder. Lift devices can also be used for loading and unloading objects, but conventional lift devices generally use hydraulic systems or the like to move loading platforms straight up and down. With this type of lift device, it is necessary for a person to move the objects between the loading platform and the high surface. Furthermore, crane systems are capable only of reducing human labor, and cannot be expected to greatly reduce the time required for loading and unloading; nor are these systems suitable for firefighting and the like, where speed is important.

Japanese Laid Open Patent Application No. JP-2001-163599-A describes the development and use of a lift device in which a carrier, bearing various types of objects, is lowered at an inclination from a high surface, such as the top of a vehicle, by swinging a swing arm.

However, while the previously developed lift device is useful in that it allows objects such as rescue ladders used by firefighting vehicles and the like to be quickly and easily loaded or unloaded without going up onto the top surface of the vehicle, when the high surface is particularly high, or the length of the carrier is increased to accommodate long objects such as ladders, the length of the swing arm must be increased by a corresponding amount. This presents a disadvantage in that, if the swing arm is long, the swing diameter thereof increases so that, when working in an enclosed space having a low ceiling or beneath overhead wires, the top of the carrier may collide with obstacles such as ceilings or overhead wires when the swing arm is swung.

Furthermore, if an obstacle is present directly below the high surface, it is not possible to lower the carrier from the high surface, because the bottom of the carrier will collide with this obstacle.

SUMMARY OF THE INVENTION

The present invention provides a means for overcoming the difficulties encountered in such situations, and an object of the present invention is to reduce the risk of the carrier colliding with overhead wires or the like when these are present above the high surface, and to allow the carrier to be smoothly raised and lowered when carrying long objects such as ladders.

In order to achieve the aforementioned object, the present invention provides a vehicle equipped with a lift device comprising: a carrier for bearing objects; a horizontal rotary shaft; a swing arm having one end that is fixed to the rotary shaft and another end that is rotatably coupled to one end of the carrier; and a drive for swinging the swing arm around the rotary shaft on top of the vehicle, so that the carrier is lowered from the top of the vehicle at an inclination such that the side on which the swing arm is joined to the carrier is raised, the swing arm comprising a first arm fixed to the rotary shaft and a second arm provided so as to be mobile in the longitudinal direction of the first arm and coupled to one end of the carrier, the lift device comprising telescoping means for displacing the second arm along the first arm during the swing of the swing arm, so that the point at which the swing arm is joined to the carrier is retracted toward the rotary shaft when the swing arm is in an upright posture.

The present invention further provides a lift device comprising: a carrier for bearing objects; a horizontal rotary shaft; a swing arm having one end that is fixed to the rotary shaft and another end that is rotatably coupled to one end of the carrier; and a drive for swinging the swing arm around the rotary shaft on a high surface, so that the carrier is lowered from the high surface at an inclination such that the side on which the swing arm is joined to the carrier raised, the swing arm comprising a first arm fixed to the rotary shaft and a second arm provided so as to be mobile in the longitudinal direction of the first arm and coupled to one end of the carrier, the lift device comprising telescoping means for displacing the second arm along the first arm during the swing of the swing arm, so that the point at which the swing arm is joined to the carrier is retracted toward the rotary shaft when the swing arm is in an upright posture.

According to one aspect of the present invention, the lift device described above is such that the arm telescoping means comprise: a carriage provided so as to be mobile along the high surface in a direction orthogonal to the rotary shaft; a first linkage linking the first arm to the carriage so as to convert the swinging motion of the swing arm into reciprocating motion of the carriage; and a second linkage that links the second arm and the carriage so that the second arm is retracted toward the rotary shaft when the swing arm is in an upright posture.

According to another aspect of the present invention, a support device that supports the carrier so that it is mobile in the longitudinal direction, and support position displacement means, whereby the support device is caused to project horizontally from the high surface when the carrier is lowered, are provided. Furthermore, the support position displacement means comprise a slide member, displaceable along the high surface in a direction orthogonal to said rotary shaft, on which the support device is mounted, and a connecting rod for linking the support device and the first arm or the slide member and the first arm.

BRIEF DESCRIPTION OF THE DRAWINGS

These and other features, aspects, and advantages of the present invention will be better understood with regard to the following description and accompanying drawings where.

DETAILED DESCRIPTION OF THE INVENTION

Figure 1:
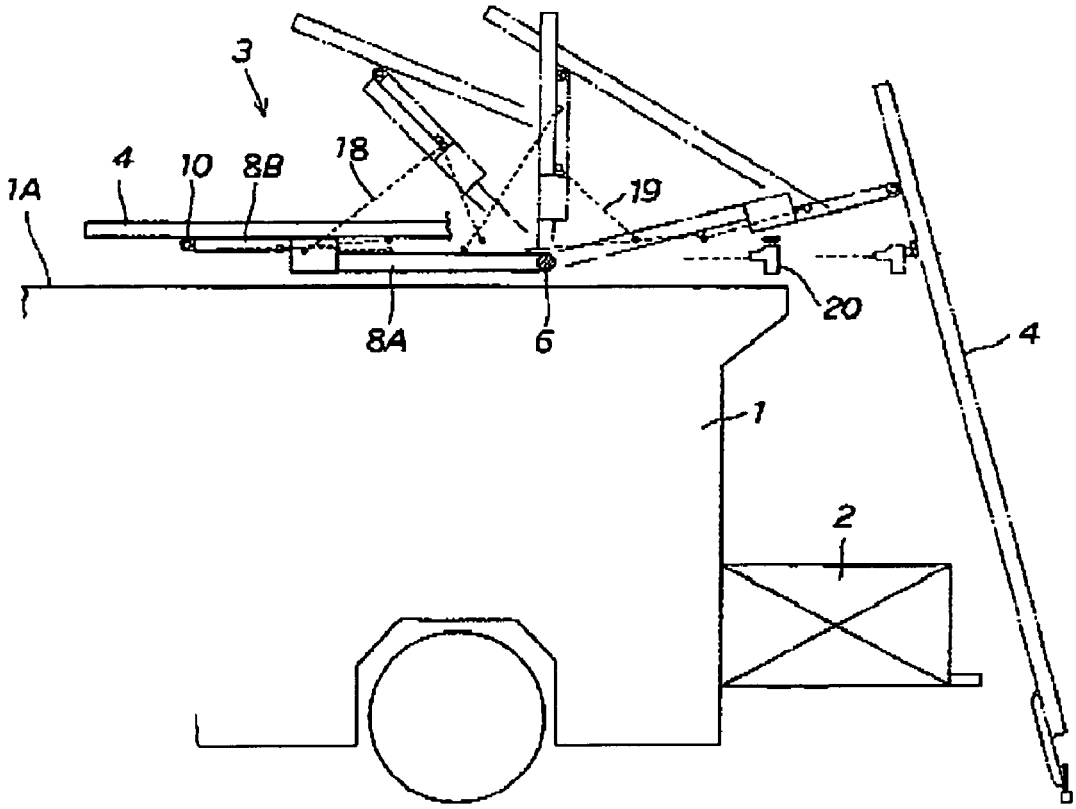
FIG. 1 shows a schematic side view showing a vehicle equipped with a lift device according to the present invention.

Referring now to the drawings, FIG. 1 illustrates a vehicle (in the present example, a firefighting vehicle) equipped with a lift device according to the present invention. As shown in FIG. 1, a crane base 2, which supports the bottom end of a boom (not shown in the drawing), is provided at the rear of a box-like vehicle body 1, and a lift device 3 for loading and unloading objects is provided on a vehicle top surface 1A, which constitutes the high surface. This lift device 3 comprises an elongate carrier 4, mounted on the vehicle top surface 1A, and an object to be loaded or unloaded, such as a telescoping ladder, can be removably mounted on this carrier 4. The carrier 4 is horizontally installed on the vehicle top surface 1A in the lengthwise direction of the vehicle, and when an object loaded on the carrier 4 is to be taken down from the vehicle top surface, the carrier is lowered rearward from the vehicle top surface 1A at an inclination, as shown by the imaginary lines in FIG. 1, with the object loaded on this carrier.

Figure 2:
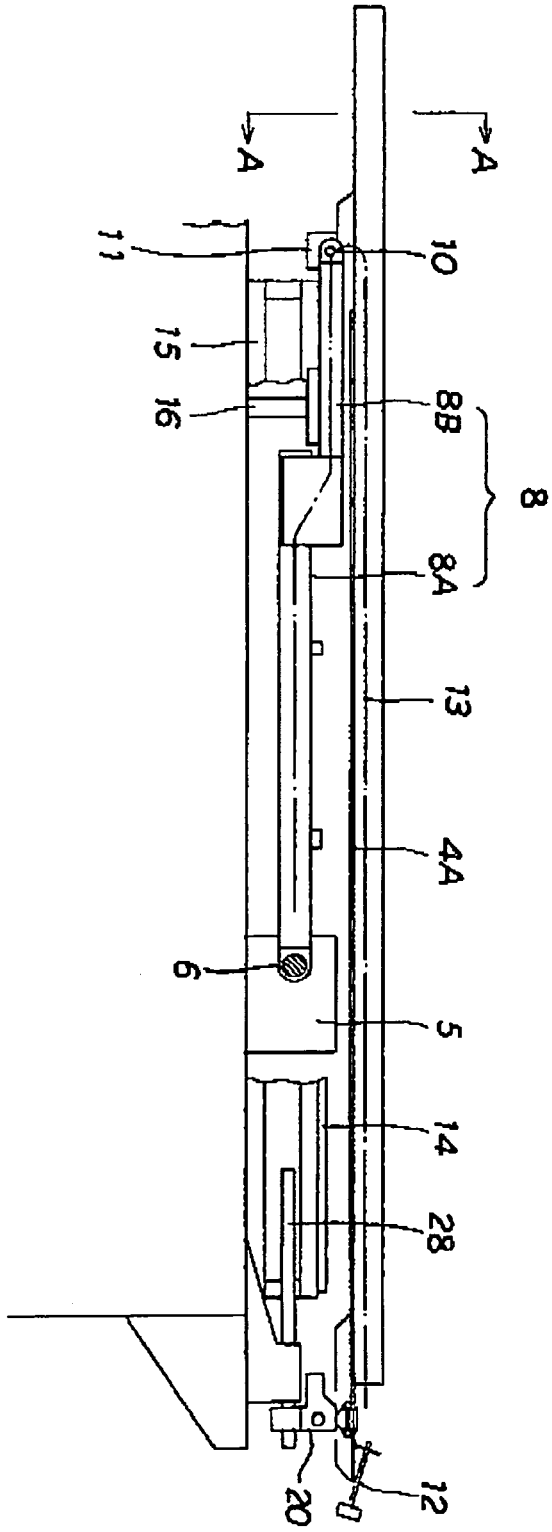
FIG. 2 shows a partially cutaway side view of the lift device shown in FIG. 1.
Figure 3:
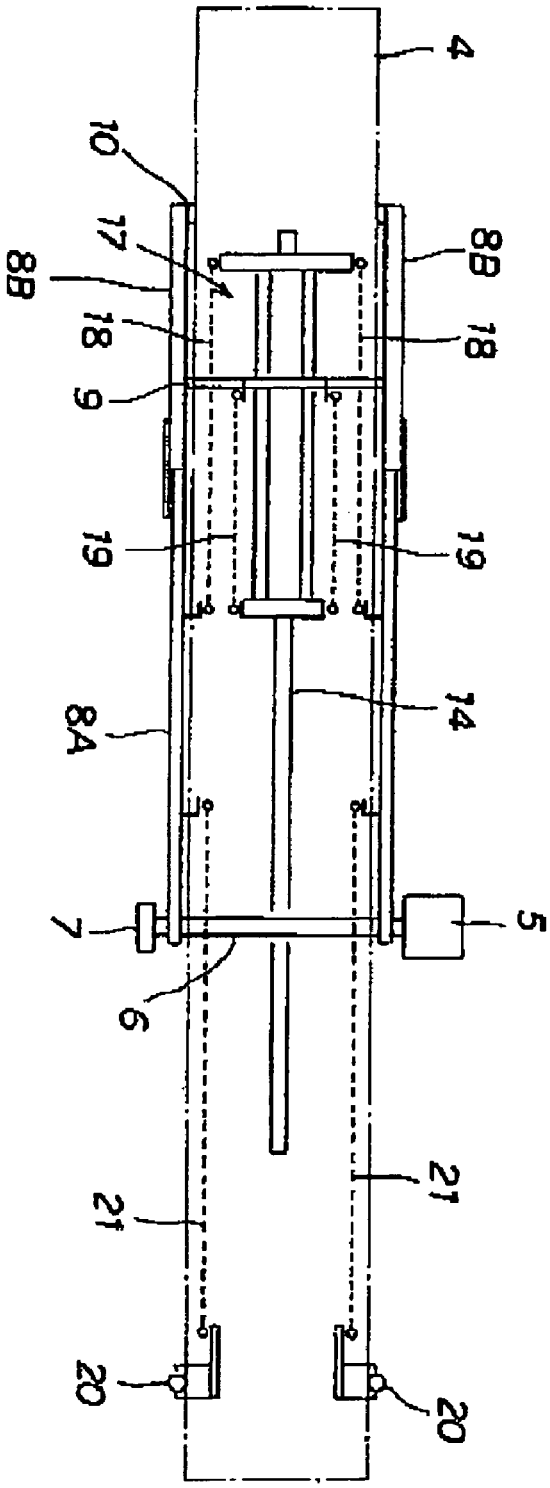
FIG. 3 is a schematic plane view of the lift device shown in FIG. 1.
Figure 4:
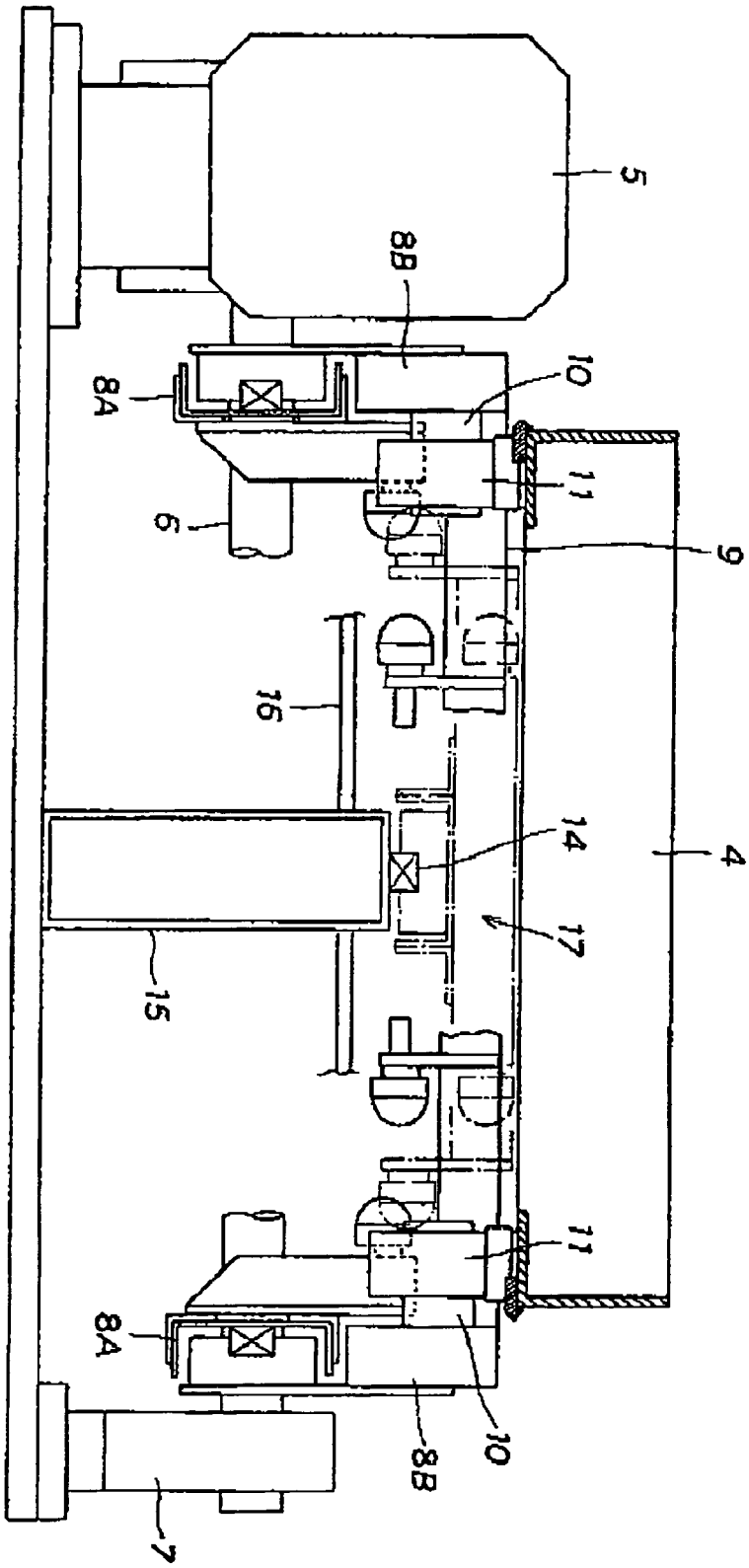
FIG. 4 is an enlarged sectional view according to line A—A in FIG. 2.

As shown in FIGS. 2–4, a drive 5 comprising a motor equipped with a worm-gear reducer and having as a power source a battery (not shown in the figures) is installed on the vehicle top; and control switch, not shown in the figures, is provided on the side of the vehicle, whereby the drive 5 rotationally drives an output shaft in the forward or reverse direction. A rotary shaft 6 is coupled to the output shaft of the drive 5. This rotary shaft 6 is disposed horizontally on the vehicle top surface 1A in the crosswise direction of the vehicle, and one extremity thereof is rotatably supported by a bearing unit 7. Note that the rotary shaft 6 is equipped with a conventional governor (not shown in the figures) and this governor is capable of mitigating torque fluctuation caused by the angular displacement of the swing arm, as described below.

The pair of left and right swing arms swing up and down with the rotary shaft as a pivot shaft. On both sides of the carrier 4, the swing arms 8 have a telescopic structure comprising a first arm 8A, one end of which is fixed to the rotary shaft 6, and a second arm 8B, which is mobile in the longitudinal direction of the first arm. The pair of second arms 8B, on the left and the right, are connected by cross-bridge shaft 9, both ends of which are rotatably coupled to one end of the carrier 4 by a coupling pin 10. Note that a bracket 11 is provided at one end of the carrier 4, so as to support the coupling pin 10, which serves to couple one end of the second arm 8B. At the other end of the carrier 4, in addition to a grounding foot 12, as shown in FIG. 2, a sensor is provided for stopping the drive 5 when grounding is detected (which is not shown in the figures). It may be noted that, as shown by the imaginary line in FIG. 2, a transmission wire 13, which is connected to this sensor, extends as far as the rotary shaft 6, passing over the carrier 4 and the swing arm 8.

Meanwhile a guide rail 14 is laid between this pair of swing arms 8 and 8, on the vehicle top surface 1A. As shown in FIG. 2 and FIG. 4, a stand 15 supports the guide rail, and a striker 16 is mounted on this stand 15 so as to support the swing arm 8 when the swing arm is horizontal. Furthermore, as shown in FIG. 3 and FIG. 4, a carriage 17 is mobile in the longitudinal direction along the guide rail and orthogonal to the rotary shaft 6; the front of this carriage 17 is linked to the first arm 8A by a first linkage 18, and the back of the carriage 17 is linked to the second arm 8B (cross-bridge shaft 9) by a second linkage 19. Meanwhile, a pair of left and right support devices 20, disposed at both sides of the rear of the vehicle top surface 1A, support the carrier 4 so that the carrier 4 is mobile in the longitudinal direction thereof. As shown in FIG. 3, this support device 20 is connected to the pivot side (rotary shaft side) of the first arm 8A by a third linkage (connecting rod 21).

Figure 5:
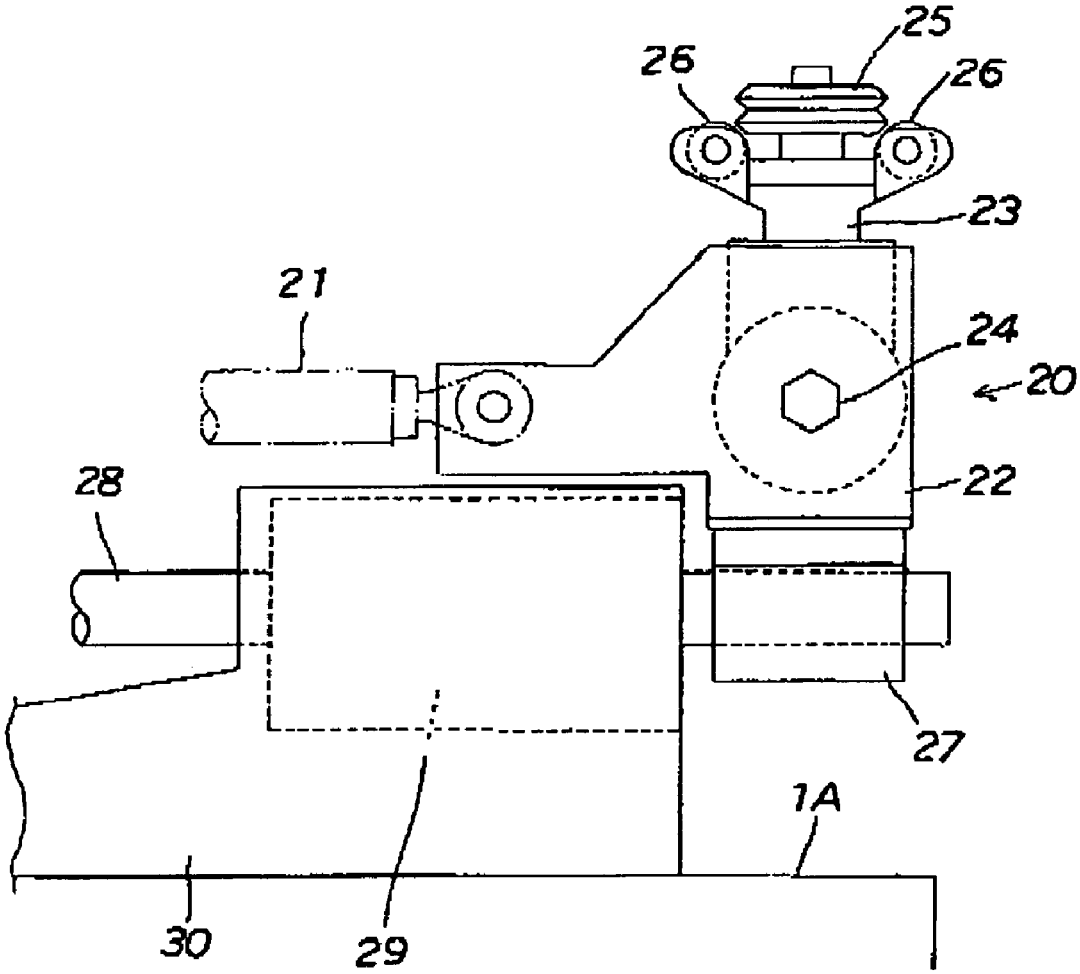
FIG. 5 is a side view the support device of the present invention.
Figure 6:
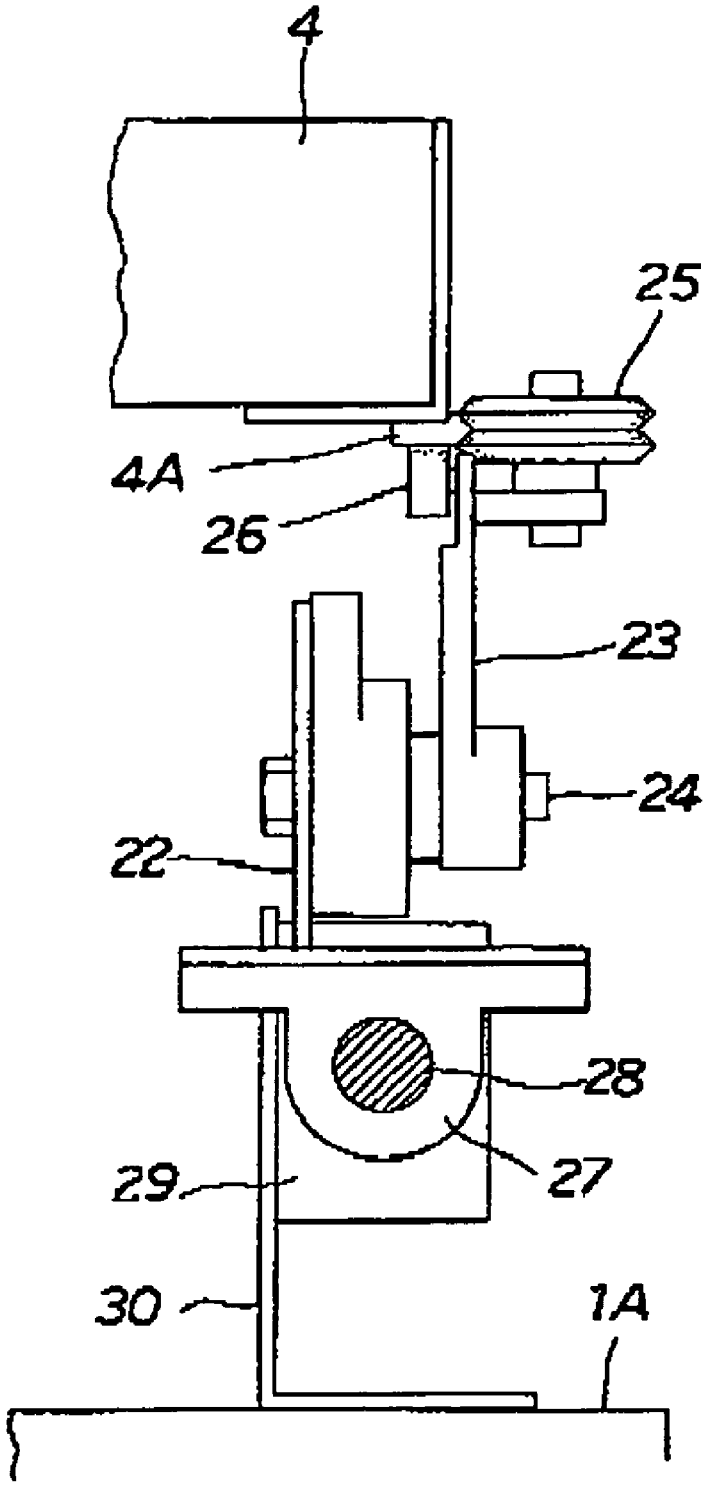
FIG. 6 is a rear view of the support device of the present invention.

This support device 20 has a structure such as that shown in FIG. 5 and FIG. 6, wherein a swing link 23 is mounted on a T-shaped base 22. The swing link 23 swings around a pin 24, which serves as a pivot, and at the top of the swing link 24, a grooved guide roller 25, rotatable around the perpendicular axis thereof, and auxiliary rollers 26, rotatable around horizontal axes, are provided. Note that, as shown in FIG. 6, a protrusion 4A protrudes laterally from the bottom of the carrier 4, and this protrusion 4A engages in the groove of the guide roller 25, while the auxiliary rollers 26 are in contact with the bottom of this protrusion 4A.

Meanwhile, a mount 27, having a through hole, is provided on the bottom of the base 22, and one end of a slide member (in the present example, a sectionally circular slide shaft 28) is inserted into this mount 27. A bearing 29 slidably supports the slide shaft 28 in the longitudinal direction thereof; and this bearing 29 is fixed by way of an angle plate 30 or the like to the vehicle top surface 1A at both sides of the rear thereof. Note that the slide shaft 28 is in line with the vehicle top surface 1A and oriented in a direction orthogonal to the rotary shaft that forms the center of swing of the aforementioned swing arms, and that the base 22 (or the slide shaft 28) of the support device 20 is connected to one end of the connecting rod 21.

Thus, by virtue of the support device 20 that has the structure described above, the swing link 23 swings around ? the pin 24 as a pivot in response to the upward or downward motion of the carrier 4, and the guide rollers 25, together with the auxiliary rollers 26, support and guide the displacement of the carrier 4 in the longitudinal direction thereof. In particular, as shown in FIG. 1, in response to the movement of the swing arm 8, the support device 20 as described above is horizontally displaced, in the longitudinal direction orthogonal to the rotary shaft 6, by support position displacement means comprising the connecting rod 21, the slide shaft 28 and the bearing 29; and when the carrier 4 is lowered, it projects horizontally rearward from the high surface (vehicle top surface 1A), so that the descent point of the carrier 4 is distanced from the vehicle top surface 1A and the bottom of the carrier 4 does not collide with obstacles (in the present example, the crane base 2 shown in FIG. 1).

Figure 7:
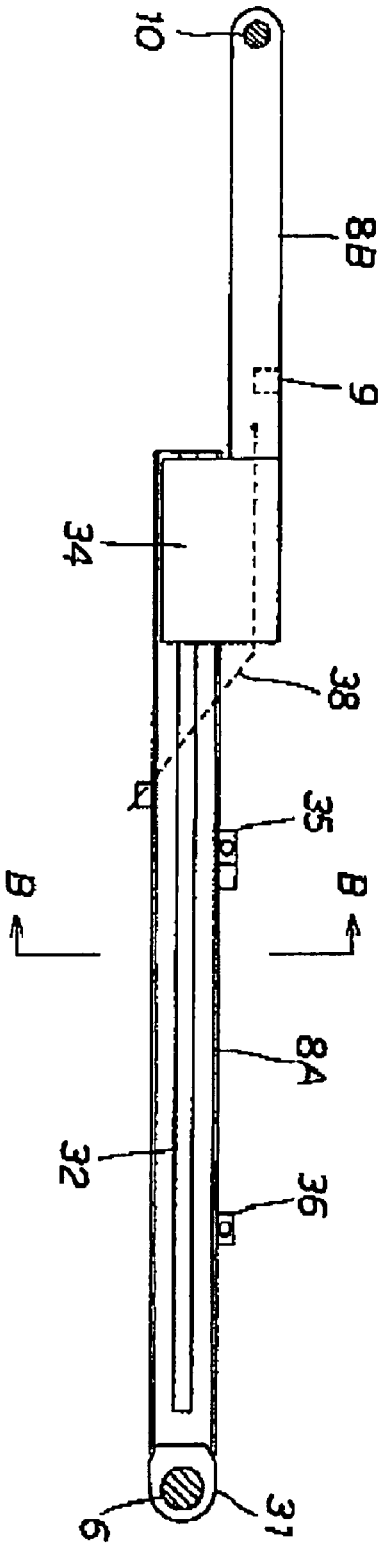
FIG. 7 is a side view of the swing arm of the present invention.
Figure 8:
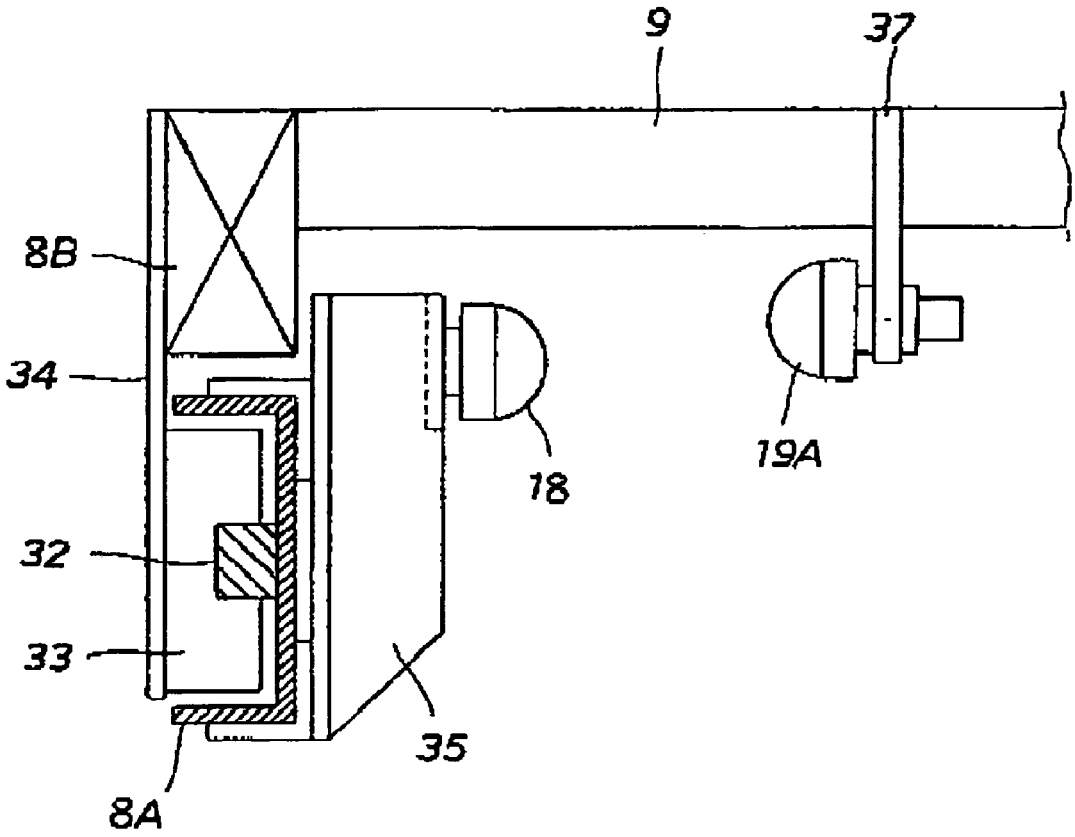
FIG. 8 is a partial enlarged sectional view of the swing arm according to the line B—B in FIG. 7.
Figure 9:
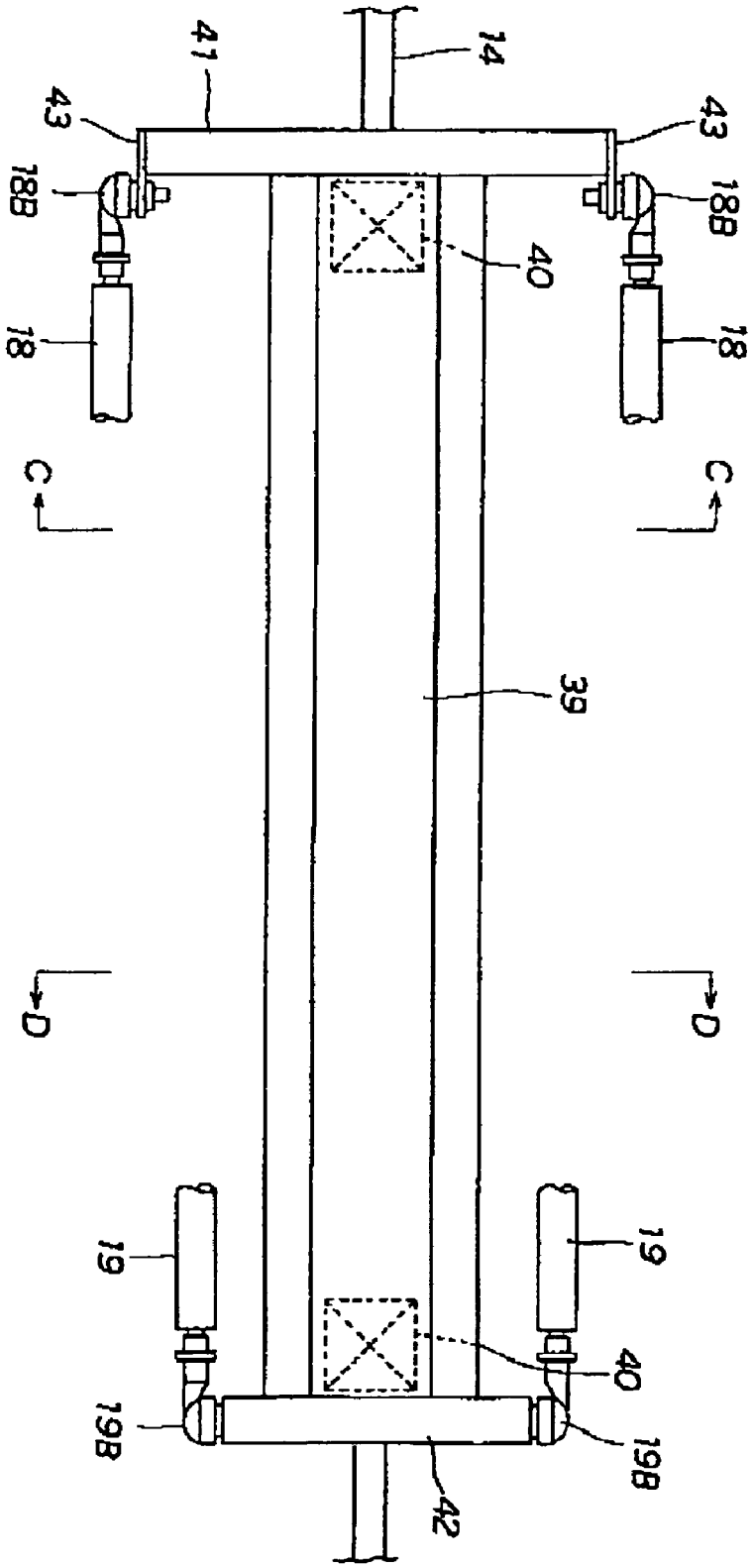
FIG. 9 is a plane view of the carriage of the present invention.
Figure 10:
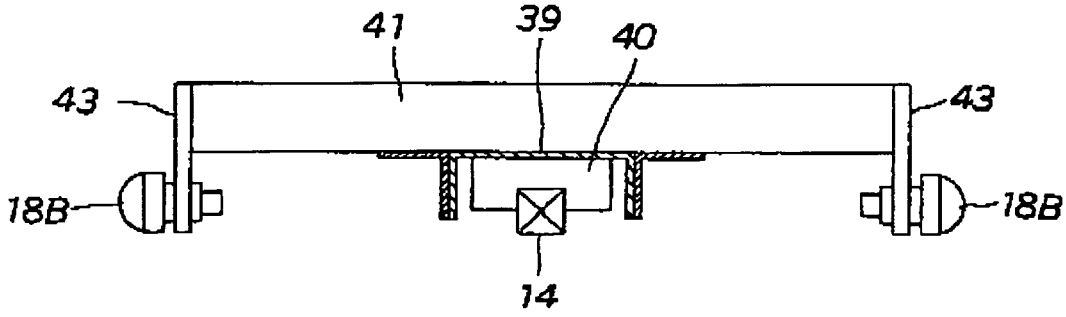
FIG. 10 is an enlarged sectional view of the carriage according to the line C—C in FIG. 9.
Figure 11:
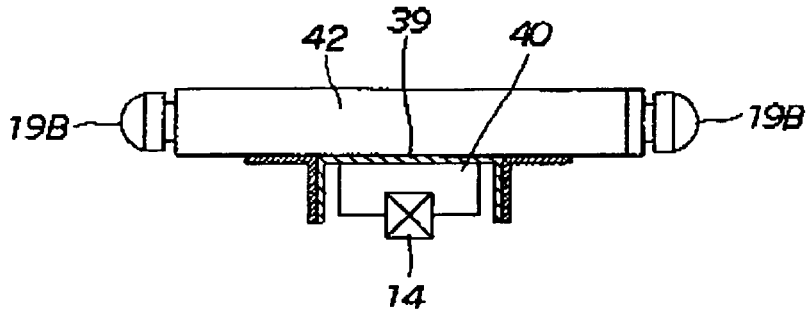
FIG. 11 is an enlarged sectional view of the carriage according to the line D—D in FIG. 9.

As shown in FIG. 7 and FIG. 8, the first arm 8A, which forms the trunk of the swing arm 8, comprises an elongate member, made of channel steel or the like, having a U-shaped section, at one end of which a connector coupling 31 is mounted, in order to fix the rotary shaft 6, and a rail 32 is mounted along the entire interior length thereof. As shown in FIG. 8, a slider 33 that slides in the longitudinal direction of the rail 32 mates therewith, and this slider 33 is coupled to one end of the second arm 8B by a fastening plate 34. Furthermore, two brackets 35 and 36 are provided at positions on the first arm 8A that are out of the path of the second arm 8B; one end of the aforementioned connecting rod 21 is connected to the pivot side bracket 36, while one end 18A of the first linkage is connected to the other bracket 35.

Meanwhile, the second arm 8B is parallel to the first arm 8A, and on the cross-bridge shaft 9 that extends to the back side thereof, a bracket 37 is provided for connecting one end 19A of the second linkage, as shown in FIG. 8. Thus, the swing arm 8, as described above, telescopes during its swing as a result of the action of arm telescoping means comprising the first linkage 18, the second linkage 19 and the aforementioned carriage 17, so that the point at which the second arm 8B and the carrier 4 are joined by the coupling pin 10 retracts toward the rotary shaft 6 when this is in an upright posture.

Here, the term "upright posture," as applied to the swing arm 8, is not limited to that wherein the swing arm forms a 90° angle with the vehicle top surface 1A, but encompasses the range from 80 to 110°. Note that, according to the telescopable swing arm 8 described above, a toggle link 38 (indicated by the dotted line in FIG. 7) is provided between the first arm 8A and the second arm 8B and flexes to accommodate the telescoping thereof, so that the wire 13 does not go slack as a result of this telescoping. The wire 13 is attached along the length of this toggle link 38.

As shown in FIGS. 4 and 9–11, the carriage 17 is constructed so that a main frame 39 comprises channel steel of a predetermined length, and a slide table 40, which mates with the guide rail 14, is fixed to the lower interior thereof. In particular, coupling shafts 41 and 42, comprising square pipe, are mounted on the main frame 39, at the front and rear extremities thereof, and both ends of these coupling shafts 41 and 42 protrude laterally from the main frame 39. The overall length of the forward coupling shaft 41 is established so as to be longer than that of the rear coupling shaft 42, and at both ends thereof brackets 43 are provided for connecting one end 18B of the first linkage. The overall length of the rear coupling shaft 42 is established so as to be shorter than that of the forward coupling shaft 41, and at both ends thereof one end 19B of the second linkage is connected.

Next, the operation of the lift device having the aforementioned construction is described. First, in the case of unloading objects that have been loaded onto a vehicle, the control switch (not shown in the figures; switchable between UP and DOWN by way of two buttons) is operated so as to activate the drive 5, whereby the rotary shaft 6 is rotated in a predetermined direction. Whereupon the swing arm 8 begins to swing synchronously upward with the rotary shaft 6 as a pivot, whereby the carrier 4 begins to descend in the rearward direction of the vehicle, with the point at which it is joined to the swing arm 8 by the coupling pin 10 raised.

At the same time, the ends of the first linkage 18 and the second linkage 19, which are connected to the swing arm 8, rise, so that the carriage 17 is pulled from the front of the vehicle top surface 1A toward the rotary shaft 6 by the first linkage 18, while the second arm 8B is also pulled toward the same rotary shaft 6 by the second linkage 19. Furthermore, as a result of the swing of the swing arm 8, the support device 20, supporting the carrier 4, is displaced rearward by the connecting rod 21. Then, when the swing arm 8 reaches the upright posture, the second arm 8B is retracted toward the rotary shaft 6 and the point at which it joins the carrier 4 is pulled downward to the lowest position.

Furthermore, when the swing arm 8 transitions from the upright posture to the downward swing, the rearward displacement of the support device 20 is continued by the connecting rod 21, while the direction of travel of the second arm 8B is reversed by the second linkage 19, and the second arm 8B is subject to the pushing force of the second linkage 19, beginning the displacement thereof along the first arm 8A, in the direction distancing it from the rotary shaft 6. Thus, when the swing arm 8 has swung approximately 160°, the grounding foot 12 provided at the back edge of the carrier 4 makes contact with the ground, and the drive 5 is stopped as a result of this being detected by the sensor, not shown in the figures. In this state, the ladder or other object that was loaded on the carrier 4 can be removed from the carrier 4 and made available for use. Note that, as described above, a governor on the rotary shaft 6 mitigates variations in torque due to the angular displacement of the swing arm 8, but the first linkage 18 and the second linkage 19 also serve to support the swing arm 8 during the swing thereof, so as to mitigate variations in the torque acting on the rotary shaft 6.

Next, in order to return the object to the top of the vehicle 1 after use, the object is leant against the carrier 4, which remains in the lowered position, and is fixed in place. Arranged in this manner, the drive 5 is run in reverse by operating the control switch, not shown in the figures. Whereupon, the swing arm 8, accompanied by the carrier 4, swings in the direction opposite to that described above. When it lies horizontal on the vehicle top surface 1A, it presses a switch, not shown in the figures, which stops the drive 5. The cross-bridge shaft 9 on the swing arm 8, which rests against the striker 16, supports one end of the carrier 4 in the horizontal position.

In the foregoing, one embodiment of the present invention has been described, but the present invention is not limited to the embodiment described above. For example, in addition to firefighting vehicles, the present invention can be applied to trucks or railroad cars. Nor are the objects carried limited to elongate objects such as ladders, but rather various different types of objects can be loaded and unloaded with the present invention. Furthermore, in addition to a vehicle equipped with a lift device, the present invention provides a lift device for placing objects on, and removing objects from, high surfaces such as shelves and the roofs of houses.

As described above, by virtue of the present invention, the first arm and the second arm afford the swing arm with a telescoping structure, providing arm telescoping means whereby the second arm is displaced along the first arm during the swing of the swing arm whereby, when the swing arm is in the upright posture, the point at which this is joined to the carrier retracts towards the rotary shaft, so that the carrier can be lowered while maintaining a low profile whereby, even in places where overhead wires are present, the carrier will not collide with the overhead wires.

In particular, the arm telescoping means comprises: a carriage provided so as to be mobile along the high surface in the direction orthogonal to the rotary shaft; a first linkage linking the first arm to the carriage so as to convert the swinging motion of the swing arm into reciprocating motion of the carriage; and a second linkage linking the second arm and the carriage so that the second arm is retracted toward the rotary shaft when the swing arm is in the upright posture. Consequently, the drive that swings the swing arm also serves to telescope the swing arm, so that swinging and telescoping of the swing arm are suitably performed, without the need for special timing circuits.

Furthermore, a support device that supports the carrier so that it is mobile in the longitudinal direction, and support position displacement means, whereby the support device is caused to project horizontally from the high surface when the carrier is lowered, are provided. Consequently, even if an obstacle is present directly below the high surface, the lowered position of the carrier is distanced from the high surface, so that the carrier can be lowered without colliding with the obstacle. Moreover, since the support position displacement means consist in using a connecting rod to transmit the swinging force of the swing arm to the support device, there is no need for a dedicated motor to displace the support device.

The invention claimed is:

1. A vehicle equipped for transporting a ladder on its upper surface, said ladder being transported on the vehicle while positioned along the longitudinal axis of the vehicle and on top of a lifting device used for raising and lowering the ladder from a top of the vehicle rearwardly to the ground behind the vehicle, said lifting device comprising:

an elongated carrier for bearing objects mounted horizontally on a top surface of the vehicle and parallel to the longitudinal axis of the vehicle, said carrier serving to carry a ladder which can be removably transported;

a horizontal rotary shaft mounted on a top surface of the vehicle and transverse to the longitudinal axis of the vehicle;

a pair of telescoping swing arms mounted along the longitudinal axis of the vehicle and having one end that is fixed to said rotary shaft and another end that is rotatably coupled to one end section of said carrier, said pair of swing arms being positioned on the vehicle forward of the rotary shaft when the ladder is at rest and horizontal on top of the lifting device; and a single drive unit mounted on a top surface of the vehicle for turning the swing arm around said rotary shaft, so that actuation of the drive unit causes rotation of the rotary shaft, a corresponding turning movement of the pair of swing arms fixed to the rotary shaft, and unloading and loading of a ladder attached to the swing arms, said ladder being moved along the longitudinal axis of the vehicle and unloaded at the back of the vehicle, said carrier being lowered from the top of the vehicle at an inclination such that the side on which said swing arm is joined to said carrier is raised, said telescoping swing arms comprising a pair of first arms fixed to each end of said rotary shaft at both ends of said rotary shaft and a pair of second arms provided so as to be mobile along the longitudinal axis of said first arms and coupled to one end of said carrier on both sides of the carrier, the lift device comprising telescoping means used during loading and unloading operations for displacing said second arms along the longitudinal axis of said first arms during rotation of said pair of swing arms, so that the point at which said swing arms are joined to said carrier is retracted toward said rotary shaft when said swing arms are rotated from a horizontal position forward of the rotary shaft to an upright posture above the rotary shaft.

2. A lifting device for transporting a ladder or other elongated object on top of a vehicle comprising:

an elongated carrier for bearing objects mounted horizontally on a top surface of the vehicle and parallel to the longitudinal axis of the vehicle, said carrier serving to carry a ladder which can be removably transported;

a horizontal rotary shaft mounted on a top surface of the vehicle and transverse to the longitudinal axis of the vehicle;

a pair of telescoping swing arms mounted along the longitudinal axis of the vehicle and having one end that is fixed to said rotary shaft and another end that is rotatably coupled to one end section of said carrier, said pair of swing arms being positioned on the vehicle forward of the rotary shaft when the ladder is at rest and horizontal on top of the lifting device; and a single drive unit mounted on a top surface of the vehicle for turning the swing arm around said rotary shaft, so that actuation of the drive unit causes rotation of the rotary shaft, a corresponding turning movement of the pair of swing arms fixed to the rotary shaft, and unloading and loading of a ladder attached to the swing arms, said ladder being moved along the longitudinal axis of the vehicle and unloaded at the back of the vehicle, said carrier being lowered from the top of the vehicle at an inclination such that the side on which said swing arm is joined to said carrier is raised, said telescoping swing arms comprising a pair of first arms fixed to each end of said rotary shaft at both ends of said rotary shaft and a pair of second arms provided so as to be mobile along the longitudinal axis of said first arms and coupled to one end of said carrier on both sides of the carrier, the lift device comprising telescoping means used during loading and unloading operations for displacing said second arms along the longitudinal axis of said first arms during rotation of said pair of swing arms, so that the point at which said swing arms are joined to said carrier is retracted toward said rotary shaft when said swing arms are rotated from a horizontal position forward of the rotary shaft to an upright posture above the rotary shaft.

3. The lift device recited in claim 2, wherein said arm telescoping means comprises:

a carriage provided so as to be mobile along a longitudinal axis of the vehicle on an upper surface in a direction orthogonal to said rotary shaft; a first linkage connecting said first arms of said carriage so as to convert rotational movement of said swing arms into reciprocating motion of said carriage; and a second linkage connecting said second arms and said carriage so that said second arms are retracted toward said rotary shaft when said swing arms are rotated from a forward horizontal position to an upright posture.

4. The lift device recited in claim 2, comprising:

a support device that supports said carrier so that said carrier is mobile in the longitudinal direction; and support position displacement means, whereby said support device is caused to project horizontally rearwardly along the horizontal axis of the vehicle from an upper surface thereof when said carrier having a ladder thereon is lowered from the upper surface of the vehicle.

5. The lift device recited in claim 4, wherein said support position displacement means comprise:

a slide member, displaceable along the high surface in a direction orthogonal to said rotary shaft, on which said support device is mounted; and a connecting rod linking said support device and said first arm or said slide member and said first arm.

6. The lift device of claim 3, further comprising:

a support device that supports said carrier so that said carrier is mobile in the longitudinal direction; and support position displacement means, whereby said support device is caused to project horizontally from the high surface when said carrier is lowered.

* * * * *